US011851981B2

(12) United States Patent
Breerwood

(10) Patent No.: US 11,851,981 B2
(45) Date of Patent: Dec. 26, 2023

(54) HYDRAULIC LINE CONTROLLED DEVICE WITH DENSITY BARRIER

(71) Applicant: Halliburton Energy Services, Inc., Houston, TX (US)

(72) Inventor: Glen P. Breerwood, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/821,116

(22) Filed: Mar. 17, 2020

(65) Prior Publication Data

US 2020/0347697 A1 Nov. 5, 2020

(51) Int. Cl.

| | |
|---|---|
| ***E21B 34/04*** | (2006.01) |
| ***E21B 41/00*** | (2006.01) |
| ***E21B 43/01*** | (2006.01) |

(52) U.S. Cl.

CPC ..... *E21B 34/045* (2013.01); *E21B 41/0021* (2013.01); *E21B 43/0122* (2013.01)

(58) Field of Classification Search

None

See application file for complete search history.

(56) References Cited

U.S. PATENT DOCUMENTS

| | | | | |
|---|---|---|---|---|
| 2,307,221 | A * | 1/1943 | Hinnekens | D06C 3/00 26/93 |
| 4,405,014 | A | 9/1983 | Talafuse | |
| 4,467,867 | A | 8/1984 | Baker | |
| 4,475,599 | A * | 10/1984 | Akkerman | E21B 34/101 166/325 |
| 4,569,392 | A | 2/1986 | Peterman | |
| 6,082,460 | A * | 7/2000 | June | E21B 33/04 166/368 |
| 6,691,785 | B2 | 2/2004 | Patel | |
| 7,025,132 | B2 * | 4/2006 | Kent | F16K 31/1225 166/368 |
| 8,443,897 | B2 * | 5/2013 | Zeller | E21B 33/037 166/344 |
| 9,133,688 | B2 | 9/2015 | Jancha et al. | |
| 9,617,830 | B2 * | 4/2017 | Minassa | E21B 34/06 |
| 10,344,565 | B2 * | 7/2019 | Felten | E21B 43/12 |
| 2015/0292301 | A1 * | 10/2015 | Minassa | E21B 43/162 166/222 |
| 2018/0371872 | A1 | 12/2018 | Felten et al. | |

* cited by examiner

*Primary Examiner* — Matthew R Buck

*Assistant Examiner* — Douglas S Wood

(74) *Attorney, Agent, or Firm* — Scott Richardson; Parker Justiss, P. C.

(57) ABSTRACT

The disclosure provides a downhole completion device for use in a wellbore and a subterranean production well. In one embodiment, the downhole completion device includes: (1) a hydraulic line controlled device, the hydraulic line controlled device having a control line port and one or more fluid leakage paths, and (2) a density barrier having first and second ends, wherein the first end is coupled to the control line port and the second end is configured to couple to a control line extending from a surface installation, the density barrier having an axial loop relative to the hydraulic line controlled device and positioned below the fluid leakage path, thereby preventing migration of leakage fluid from the one or more fluid leakage paths to the surface installation.

24 Claims, 5 Drawing Sheets

HYDRAULIC LINE CONTROLLED DEVICE WITH DENSITY BARRIER

CROSS-REFERENCE TO RELATED APPLICATION

This application claims priority to International Application Number PCT/US2019/029993 filed on Apr. 30, 2019, entitled "HYDRAULIC LINE CONTROLLED DEVICE WITH DENSITY BARRIER," which application is commonly assigned with this application and incorporated herein by reference in its entirety.

BACKGROUND

Operations performed and equipment utilized in conjunction with a subterranean production well often require one or more hydraulic line controlled devices such as surface-controlled subsurface safety valves (SCSSVs), lubricator valves (LVs), circulating valves, completion isolation valves and the such.

Migration of hydrocarbons up the hydraulic control line presents multiple challenges once the hydrocarbons reach the wellhead. Controlling the hydrocarbons and proving the well has a barrier to prevent the hydrocarbons from relieving into the environment is one issue. Another residual issue is hydrate formation at the wellhead which prevents future use of the hydraulic control line device.

What is needed in the art are one or more hydraulic line controlled devices, and methods for use thereof, that do not experience the hydrocarbon migration issues of existing devices.

BRIEF DESCRIPTION

Reference is now made to the following descriptions taken in conjunction with the accompanying drawings, in which.

DETAILED DESCRIPTION

Figure 1:
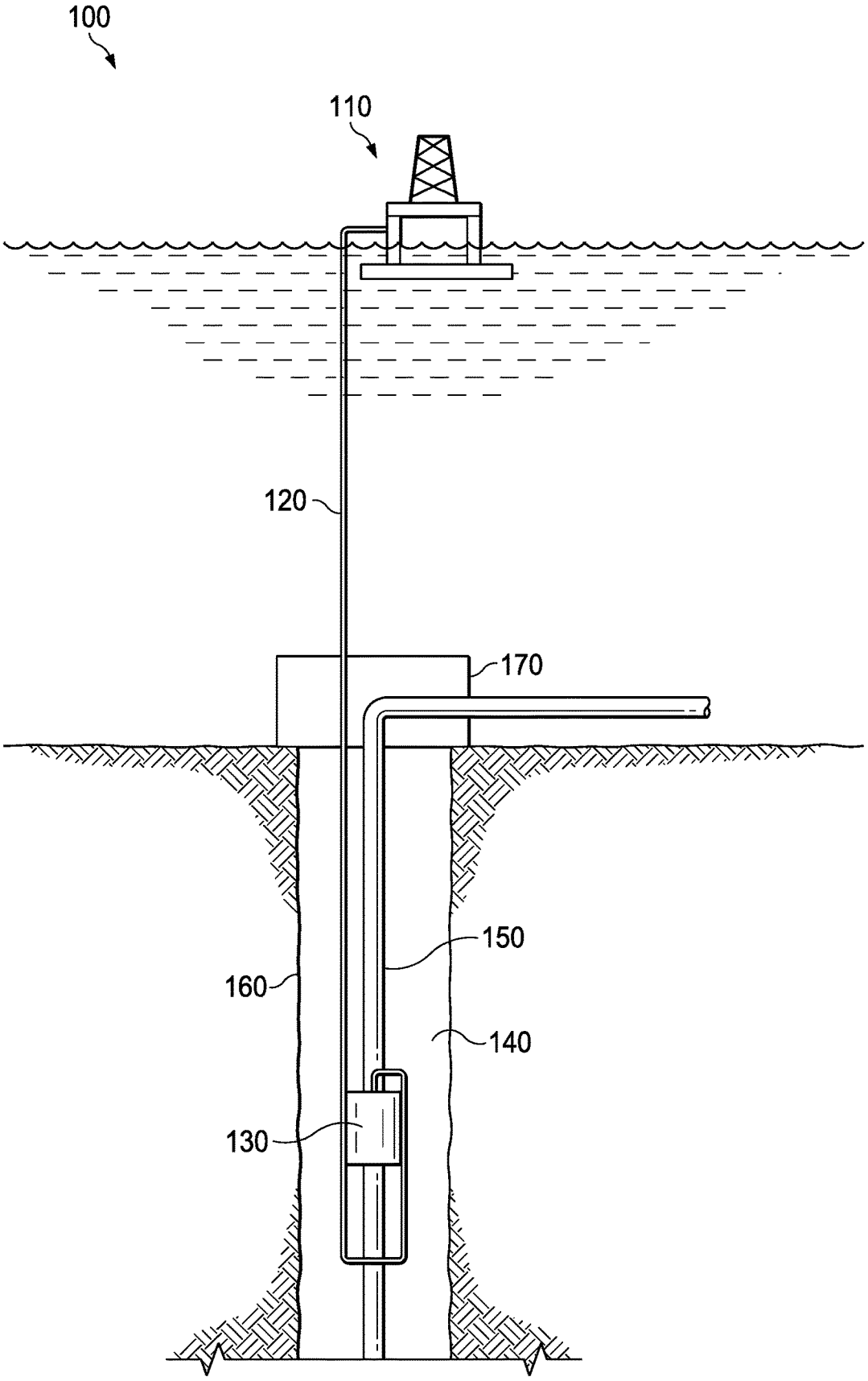
FIG. 1 illustrates a subterranean production well employing a hydraulic line controlled device constructed according to the principles of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The description and drawings included herein merely illustrate the principles of the disclosure. It will thus be appreciated that those skilled in the art will be able to devise various arrangements that, although not explicitly described or shown herein, embody the principles of the disclosure and are included within its scope.

FIG. 1 illustrates a subterranean production well 100, including an offshore platform 110 connected to a hydraulic line controlled device 130, such as an SCSSV, via hydraulic connection 120. An annulus 140 may be defined between walls of well 160 and a conduit 150. Wellhead 170 may provide a means to hand off and seal conduit 150 against well 160 and provide a profile in which to latch a subsea blowout preventer. Conduit 150 may be coupled to wellhead 170. Conduit 150 may be any conduit such as a casing, liner, production tubing, or other tubulars disposed in a wellbore.

The hydraulic line controlled device 130 may be interconnected in conduit 150 and positioned in well 160. Although the well 160 is depicted in FIG. 1 as an offshore well, one of ordinary skill should be able to adopt the teachings herein to any type of well including onshore or offshore. The hydraulic connection 120 may extend into the well 160 and may be connected to the hydraulic line controlled device 130. The hydraulic connection 120 may provide a control line for the hydraulic line controlled device 130, including the actuation and/or de-actuation of the hydraulic line controlled device 130 when it comprises a valve. In one embodiment, actuation may comprise opening the hydraulic line controlled device 130 to provide a flow path for wellbore fluids to enter conduit 150, and de-actuation may comprise closing the hydraulic line controlled device 130 to close a flow path for wellbore fluids to enter conduit 150. In accordance with one embodiment of the disclosure, the hydraulic line controlled device 130 has a control line port and one or more fluid leakage paths. In this embodiment, a first end of a density barrier is coupled to the control line port and the second end of the density barrier is coupled to a control line (e.g. hydraulic connection 120) extending from a surface installation, the density barrier having an axial loop relative to the hydraulic line controlled device and positioned below the one or more fluid leakage paths, thereby preventing migration of leakage fluid from the one or more fluid leakage paths to a surface installation (e.g., wellhead 170).

Figure 2:
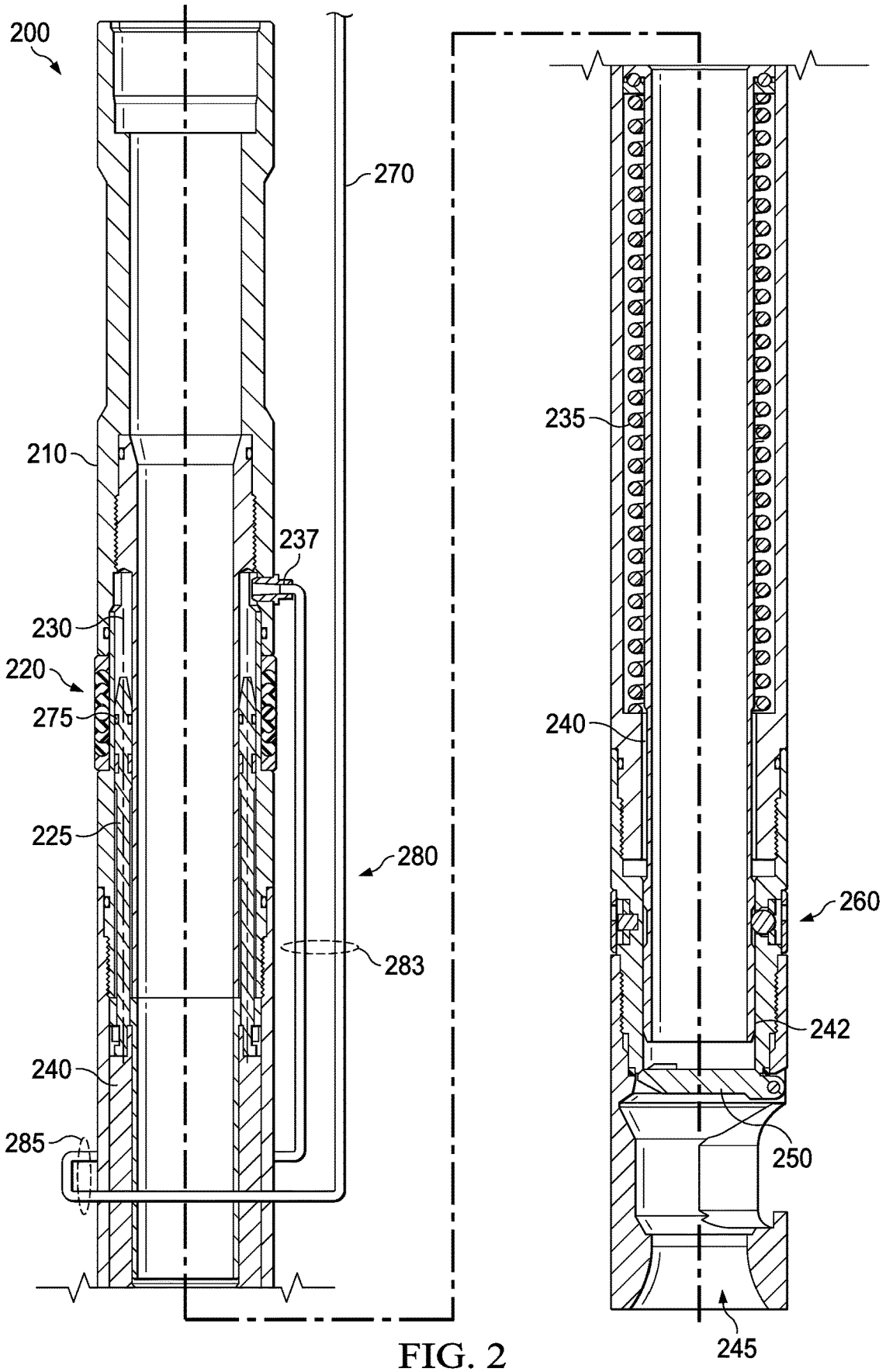
FIG. 2 is a section view of a surface-controlled subsurface safety valve (SCSSV) constructed according to the principles of the disclosure.

Referring to FIG. 2, an example hydraulic line controlled device 200 manufactured according to the disclosure is shown. While the hydraulic line controlled device 200 is illustrated as a surface-controlled subsurface safety valve (SCSSV), those skilled in the art understand that it could be configured as any hydraulic line controlled device, including for example linear valves (LVs), circulating valves, completion isolation valves, etc., and remain within the purview of the disclosure. Thus, the present disclosure should not be limited to any specific hydraulic line controlled device.

The hydraulic line controlled device 200 illustrated in FIG. 2 can be located within a wellbore and includes a housing 210 having a tubular, such as flow tube 240 positioned axially therein. Associated with the housing 210 (e.g., located in the housing 210 in one embodiment) is an actuator 220 that is configured to move the hydraulic line controlled device 200 between a closed state and an open state. The actuator 220, in the illustrated embodiment, includes one or more pistons 225 positioned within a fluid chamber 230. The one or more pistons 225 are attached to the flow tube 240 (e.g., either directly or through one or more sliding sleeves), and thus as the volume of the fluid chamber 230 changes, the flow tube 240 moves between opened and closed positions. In the embodiment of FIG. 2, a spring 235 is positioned between a shoulder in the housing 210 and an uphole end of the flow tube 240. In the embodiment of FIG. 2, the spring 235 is fully extended, thus the flow tube 240 is fully retracted, resulting in the hydraulic line controlled device 200 being in a closed position.

The hydraulic line controlled device 200 may be disposed in a wellbore as part of a wellbore completion string. The wellbore may penetrate an oil and gas bearing subterranean formation such that oil and gas within the subterranean formation may be produced. A region 245 directly below the hydraulic line controlled device 200 may be exposed to formation fluids and pressure by being in fluid communication with fluids present in the wellbore. Region 245 may be part of a production tubing string disposed of in the wellbore, for example. A valve closure mechanism 250 positioned proximate a distal end 242 (e.g., a downhole end) of the flow tube 240 may isolate region 245 from the flow tube 240, which may prevent formation fluids and pressure from flowing into flow tube 240 and thus uphole toward the surface, when valve closure mechanism 250 is in a closed state. Valve closure mechanism 250 may be any type of valve, such as a flapper type valve or a ball type valve, among others. FIG. 2 illustrates the valve closure mechanism 250 as being a flapper type valve. As will be discussed in further detail below, the valve closure mechanism 250 may be actuated into an open state to allow formation fluids to flow from region 245 through a flow path within flow tube 240, where after it may travel uphole to the surface.

When the hydraulic line controlled device 200 is in the first closed state, differential pressure across valve closure mechanism 250 will prevent wellbore fluids from flowing from region 245 into flow tube 240. In order to move the valve closure mechanism 250 into an open state, the pressure across the valve closure mechanism 250 should be substantially equalized. Equalizing device 260 may be used to equalize the pressure across both sides of the valve closure mechanism 250.

The actuator 220, in the embodiment shown, is coupled to a control line 270 for actuation thereof. The control line 270 delivers a control fluid from the surface of the wellbore to the fluid chamber 230, via a control line port 237, to control the pistons 225 and move the flow tube 240 between the opened and closed positions. The control fluid can be a fluid that is typically used to control devices in wellbores, such as a water-based or hydraulic based fluid. In one example, the control line 270 is a hydraulic line and the control fluid is a hydraulic fluid.

The fluid chamber 230 includes seals or gaskets 275 that can fail and create a fluid leakage path or paths allowing hydrocarbons (e.g., a formation fluid or gas) to enter the control line 270 from, for example, the flow tube 240, and travel to the surface. While the seals or gaskets 275 are illustrated as the leakage path in the embodiment of FIG. 2, those skilled in the art understand that other leakage paths, and thus sources of fluid leakage, are within the scope of the present disclosure. At the surface, the hydrocarbons, collectively referred to as leakage fluid, can escape to the environment or form a hydrate at the wellhead; both which are undesirable. The leakage fluid often has a density that is lower than the density of a control fluid in the control line.

To prevent the leakage fluid from travelling to the surface via the control line 270, the disclosure advantageously provides a density barrier 280 that is positioned below the fluid leakage path to prevent migration of the leakage fluid from the one or more leakage paths to the surface installation. The density barrier 280 can protect from uncontrolled migration of the leakage fluids via the control line 270 to the surface due to failures of the seals or gaskets, such as from wear and tear or simply faulty construction, or other leakage paths. The density barrier 280, in the embodiment shown, includes a first end coupled to the control line port 237 and a second end coupled to the control line 270 extending from the surface. The density barrier 280, in this embodiment, further includes an axial loop 283 relative to the actuator 220 and a circumferential loop 285 relative to the actuator 220. As noted above, density barriers as disclosed herein are not limited to a SCSSV as shown in FIG. 2, but can be employed with other hydraulic line controlled devices used in a wellbore, such as illustrated in the following figures.

Figure 3A:
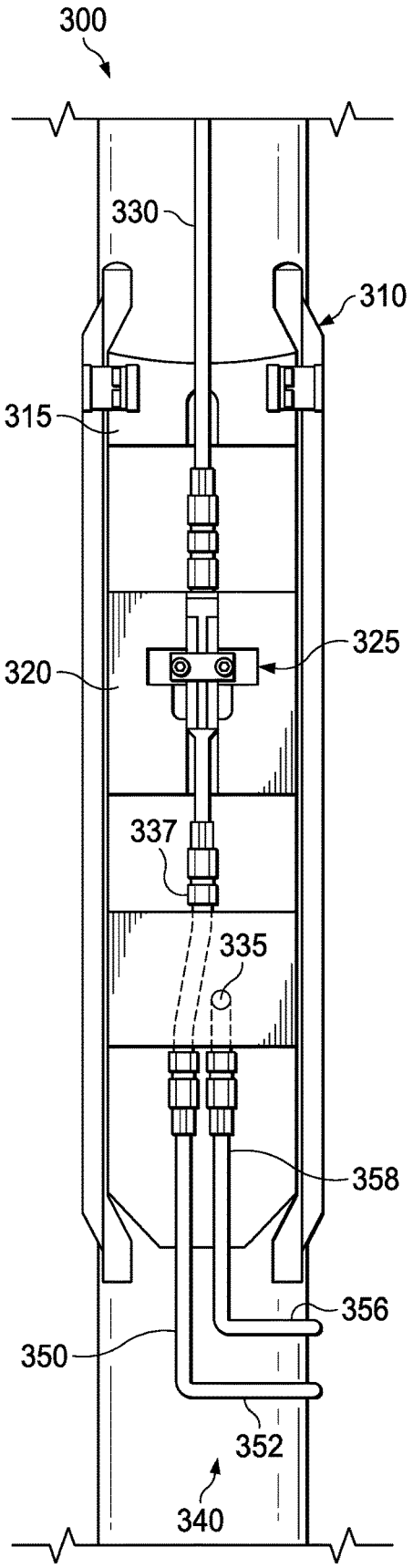
FIG. 3A is a top view of a hydraulic line controlled device constructed according to one embodiment of the disclosure.
Figure 3B:
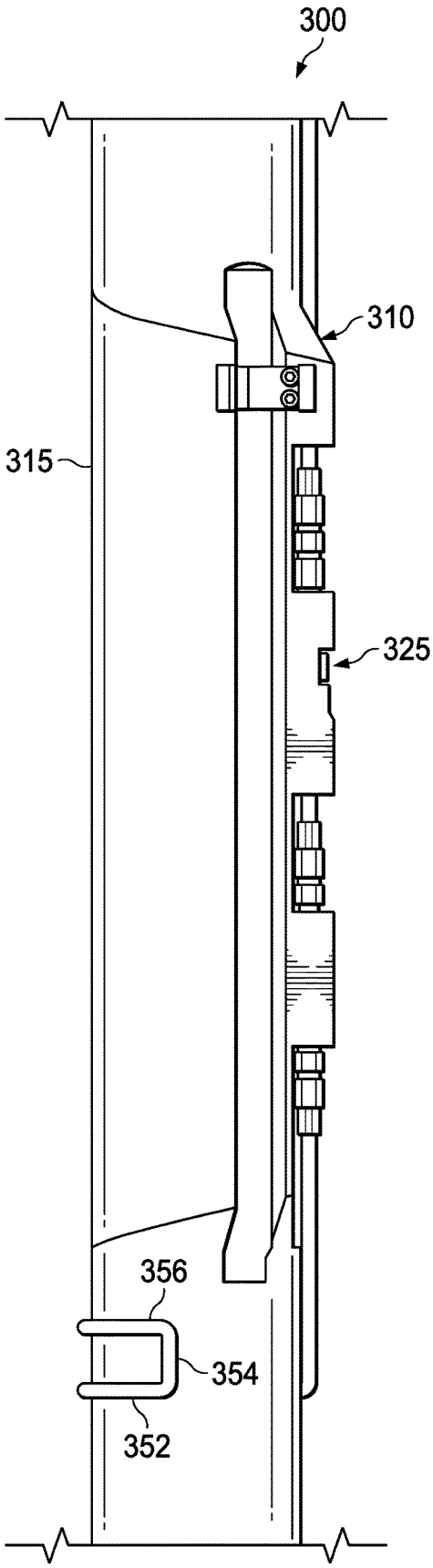
FIG. 3B is a side view of the hydraulic line controlled device constructed according to the embodiment illustrated in FIG. 3A.

Referring next to FIGS. 3A-3B, depicted is one embodiment of a downhole completion device 300 of the present disclosure. Downhole completion device 300, in the embodiment shown, includes a hydraulic line controlled device 310. Any hydraulic line controlled device is within the purview of the disclosure. Notwithstanding, the hydraulic line controlled device 310, in this embodiment, is a downhole device including a generally tubular mandrel 315 having an axially extending internal passageway that forms a portion of a flow path for the production of formation fluids through a production tubing. As used herein the term "axial" refers to a direction that is generally parallel to the central axis of mandrel 315, the term "radial" refers to a direction that extends generally outwardly from and is generally perpendicular to the central axis of mandrel 315 and the term "circumferential" refers to a direction generally perpendicular to the radial direction and the axial direction of mandrel 315. In the embodiment of FIGS. 3A and 3B, the mandrel 315 includes a support assembly 320.

In the illustrated embodiment, a fluid flow control element depicted as check valve 325 is received within support assembly 320 and is secured therein with a retainer assembly. Check valve 325 is designed to allow fluid flow in the down direction of FIG. 3A, which is downhole after installation, and prevent fluid flow in the up direction of FIG. 3A, which is uphole after installation. Check valve 325 may include redundant checks such as one hard seat and one soft seat. In the illustrated embodiment, one end of the check valve 325 is coupled to a control line 330, which preferably extends to the surface and is coupled to a control fluid pump as described above. While the check valve 325 is illustrated, it is not required in all embodiments.

In accordance with the principles of the present disclosure, a density barrier 340 is positioned between the other end of the check valve 325 and a control line port 335, as well as below the one or more fluid leakage paths 337 in the hydraulic line controlled device 310. Only a single fluid leakage path 337 has been illustrated in FIGS. 3A and 3B. Notwithstanding, while the fluid leakage path 337 is illustrated as a connection point, other fluid leakage paths (e.g., at seals, etc.) are within the scope of the present disclosure. In the illustrated embodiment, the density barrier 340 includes a substantially axially extending tubing section 350, a substantially circumferentially extending tubing section 352, a substantially axially extending tubing section 354, a substantially circumferentially extending tubing section 356 and a substantially axially extending tubing section 358. Together, tubing section 350, tubing section 354 and tubing section 358 form an axial loop. Likewise, tubing section 352 and tubing section 356 form a circumferential loop. Preferably, the circumferential loop extends around mandrel 315 at least 180 degrees. In the illustrated embodiment, the circumferential loop extends around mandrel 315 by approximately 270 degrees. As explained in greater detail below, the axial loop and the circumferential loop form an omnidirectional low density fluid trap that prevents migration of hydrocarbons from entering the one or more fluid leakage paths and travelling to the surface installation, regardless of the directional orientation of the well in which mandrel 315 is installed.

Figure 4A:
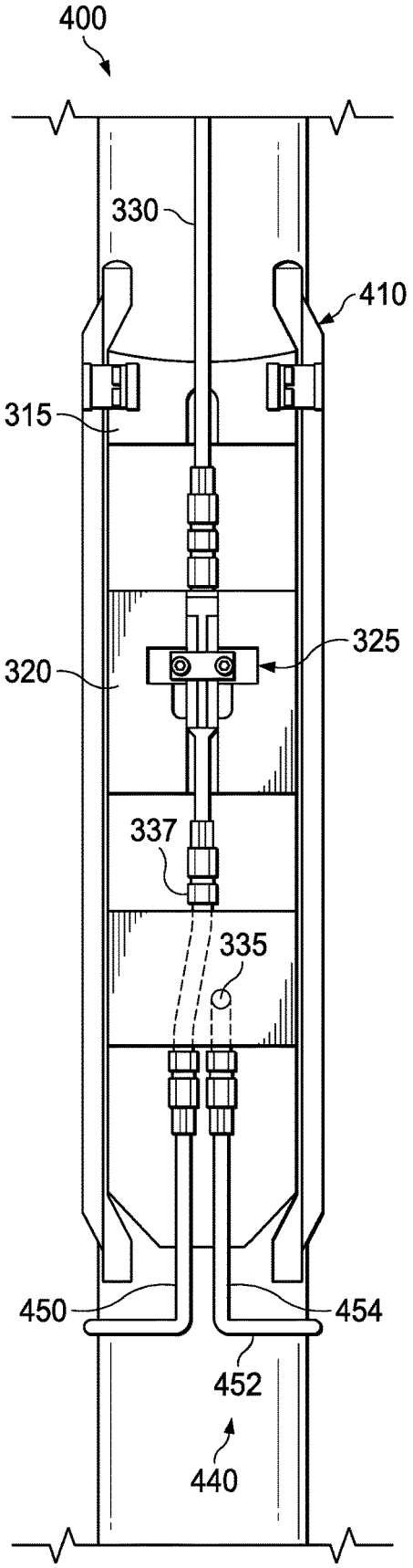
FIG. 4A is a top view of a hydraulic line controlled device constructed according to an alternative embodiment of the disclosure.
Figure 4B:
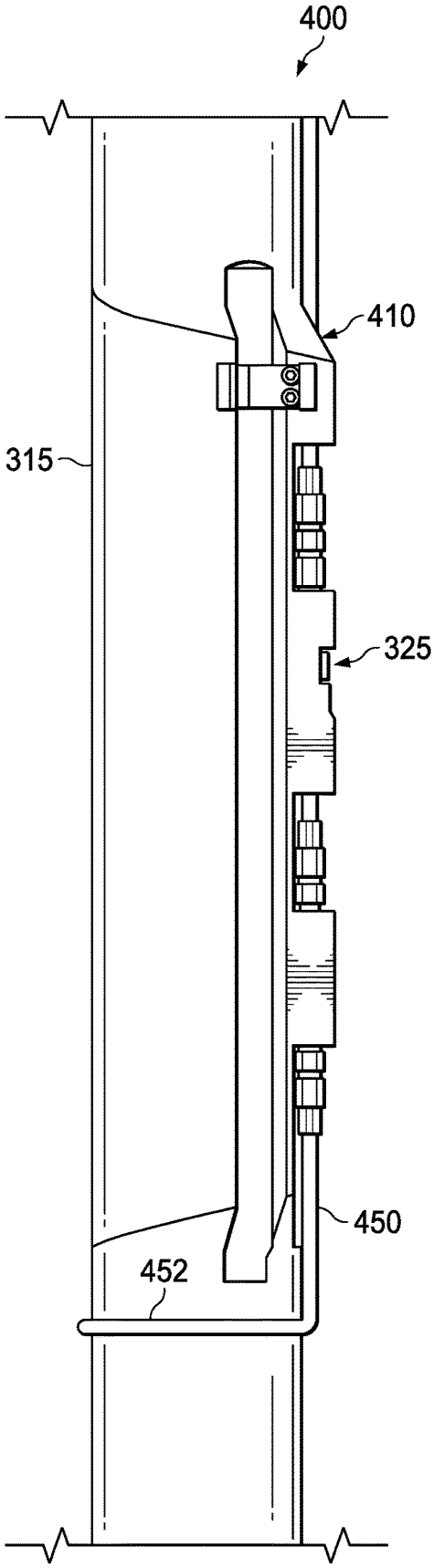
FIG. 4B is a side view of the hydraulic line controlled device constructed according to the embodiment illustrated in FIG. 4A.

Referring next to FIGS. 4A-4B, depicted is another embodiment of a downhole completion device 400 of the present disclosure. The downhole completion device 400 of FIGS. 4A-4B shares many of the same features with the downhole completion device 300 of FIGS. 3A-3B. Accordingly, like reference numerals may be used to indicate similar features. Downhole completion device 400, in the embodiment shown, includes a hydraulic line controlled device 410. In accordance with the principles of the present disclosure, a density barrier 440 forms a loop between the check valve 325 and the control line port 335. In the illustrated embodiment, the density barrier 440 includes a substantially axially extending tubing section 450, a substantially circumferentially extending tubing section 452 and a substantially axially extending tubing section 454. Together, tubing section 450 and tubing section 454 form an axial loop. Likewise, tubing section 452 forms a circumferential loop. In the illustrated embodiment, the circumferential loop extends around mandrel 315 nearly 360 degrees. As explained in greater detail below, the axial loop and the circumferential loop form an omnidirectional low density fluid trap that prevents migration of hydrocarbons from entering the one or more fluid leakage paths and travelling to the surface installation, regardless of the directional orientation of the well in which mandrel 315 is installed.

Figure 5A:
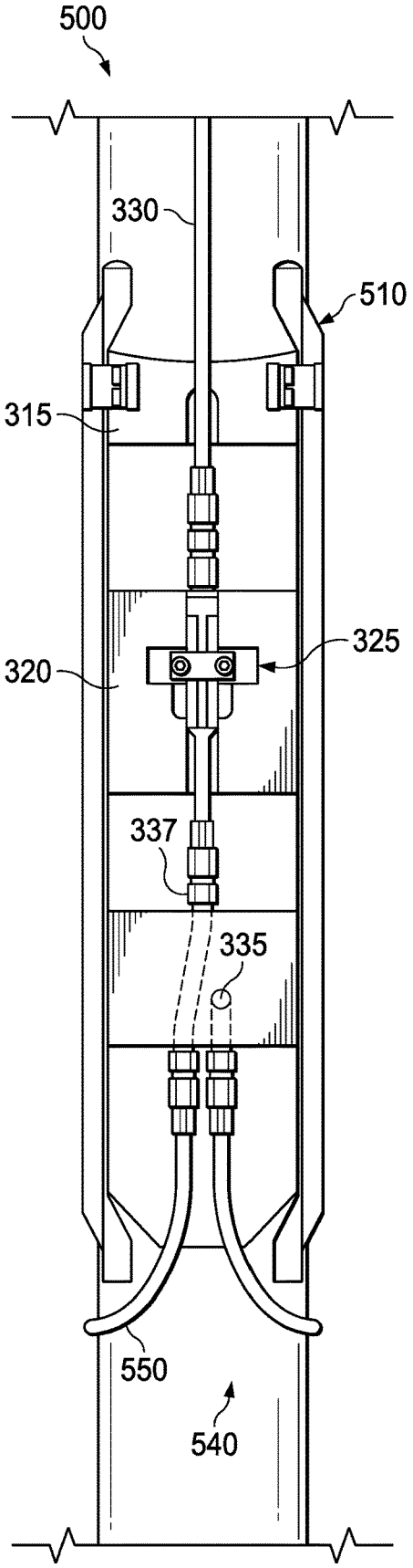
FIG. 5A is a top view of a hydraulic line controlled device constructed according to yet another alternative embodiment of the disclosure.
Figure 5B:
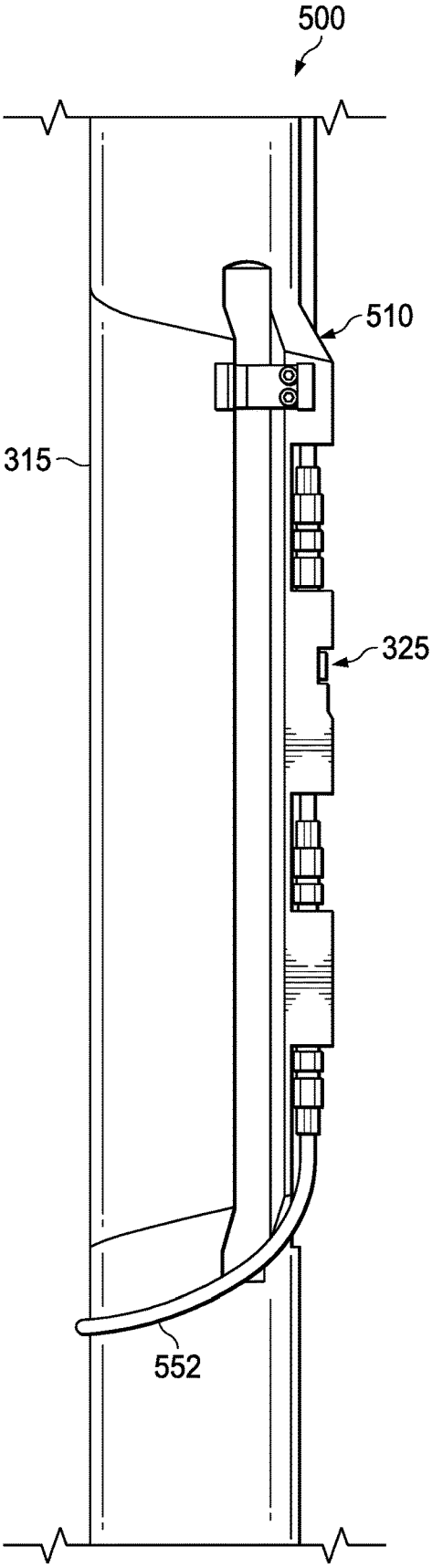
FIG. 5B is a side view of the hydraulic line controlled device constructed according to the embodiment illustrated in FIG. 5A.

Referring next to FIGS. 5A-5B, depicted is yet another embodiment of a downhole completion device 500 of the present disclosure. The downhole completion device 500 of FIGS. 5A-5B again shares many of the same features with the downhole completion device 300 of FIGS. 3A-3B and 400 of FIGS. 4A-4B. Accordingly, like reference numerals may again be used to indicate similar features. In accordance with the principles of the present disclosure, a density barrier 540 forms a loop between the check valve 325 and the control line port 335. In the illustrated embodiment, density harrier 540 includes a tubing section 550 that extends downwardly and outwardly from the check valve 325 to a lowermost point indicated at location 552 then extends upwardly and inwardly to the control line port 335. As such, tubing section 550 forms an axial loop and a circumferential loop, wherein the circumferential loop extends around mandrel 315 nearly 360 degrees. It is noted that in forming the axial loop, tubing section 550 does not extend exclusively in the axial direction, and in forming the circumferential loop, tubing section 550 does not extend exclusively in the circumferential direction. As explained in greater detail below, the axial loop and the circumferential loop form an omnidirectional low density fluid trap that prevents migration of hydrocarbons from entering the one or more fluid leakage paths and travelling to the surface installation, regardless of the directional orientation of the well in which mandrel 315 is installed.

If one or more fluid leakage paths (e.g., hydrocarbon leakage paths) exist between the hydraulic line controlled device and the wellbore, a portion of the hydrocarbons may replace leaked control fluid. The density barrier disclosed herein, however, provides an omnidirectional low density fluid trap due to its integrated axial and circumferential loops. For example, in a vertical installation, the control fluid in the axial loop of the density barrier is not displaced by the lower density formation fluid entering the fluid leakage path. Accordingly, the formation fluid is disallowed from migrating to the check valve and therefore to the control line in a vertical installation of a downhole hydraulic line controlled device. For example, in a horizontal installation, the control fluid in the circumferential loop of the density barrier is not displaced by the lower density formation fluid entering the fluid leakage path. Accordingly, the formation fluid is disallowed from migrating to the check valve and therefore to the control line in a horizontal installation of a downhole hydraulic line controlled device. As long as the circumferential loop extends at least 180 degrees around the mandrel, this remains true regardless of the circumferential orientation of the mandrel with respect to the well. Accordingly, the formation fluid is disallowed from migrating to the check valve and therefore to the control line in a horizontal installation of a downhole hydraulic line controlled device as disclosed herein. In any other directional orientation of the well between vertical and the horizontal, both the axial loop and the circumferential loop of the density barrier retain at least some of the control fluid which is not displaced by any lower density formation fluid entering the leakage path. Accordingly, in any such directional orientation, the formation fluid is disallowed from migrating to the check valve and therefore to the control line by the density barrier of the downhole hydraulic line controlled device.

Aspects disclosed herein include:

A. A downhole completion device for use in a wellbore. The downhole completion device includes a hydraulic line controlled device, the hydraulic line controlled device having a control line port and one or more fluid leakage paths; and a density barrier having first and second ends, wherein the first end is coupled to the control line port and the second end is configured to couple to a control line extending from a surface installation, the density barrier having an axial loop relative to the hydraulic line controlled device and positioned below the one or more fluid leakage paths, thereby preventing migration of leakage fluid from the one or more fluid leakage paths to the surface installation.

B. A subterranean production well. The subterranean production well includes: a surface installation; a wellbore extending into a subterranean formation below the surface installation; a conduit positioned within the wellbore and extending into the subterranean formation; a control line having an uphole end and a downhole end, the control line extending from the surface installation into the subterranean formation substantially along the conduit; and a downhole completion device coupled to the conduit, the downhole completion device including 1) a hydraulic line controlled device, the hydraulic line controlled device having a control line port and one or more fluid leakage paths, and 2) a density barrier having first and second ends, wherein the first end is coupled to the control line port and the second end is coupled to the downhole end of the control line, the density barrier having an axial loop relative to the hydraulic line controlled device and positioned below the one or more fluid leakage paths, thereby preventing migration of leakage fluid from the one or more fluid leakage paths up the control line and to the surface installation.

Aspects A and B may have one or more of the following additional elements in combination: Element 1: wherein the density barrier further includes a circumferential loop relative to the hydraulic line controlled device, the axial loop and the circumferential loop preventing migration of leakage fluid from the one or more fluid leakage paths to the surface installation regardless of a directional orientation of the hydraulic line controlled device. Element 2: wherein the axial loop and the circumferential loop form an omnidirectional low density fluid trap. Element 3: wherein the circumferential loop further comprises a single circumferentially extending tubing section. Element 4: wherein the circumferentially extending tubing section extends at least 180 degree around the hydraulic line controlled device. Element 5: wherein the circumferential loop further comprises a pair of circumferentially extending tubing sections. Element 6: wherein each of the circumferentially extending tubing sections extends at least 180 degree around the hydraulic line controlled device. Element 7: wherein at least a portion of the circumferential loop further comprises a tubing section that does not extend exclusively in the circumferential direction. Element 8: wherein at least a portion of the axial loop further comprises a tubing section that does not extend exclusively in the axial direction. Element 9: wherein the axial loop further comprises a pair of axially extending tubing sections. Element 10: wherein the leakage fluid is at least one of a liquid and a gas having a density that is lower than the density of a control fluid in the control line. Element 11: further including a check valve supported by the hydraulic line controlled device, the check valve oriented such that it is configured to be in downstream fluid communication with the control line extending from the surface installation.

Those skilled in the art to which this application relates will appreciate that other and further additions, deletions, substitutions and modifications may be made to the described embodiments.

What is claimed is:

1. A downhole completion device for use in a wellbore, comprising:

a hydraulic line controlled device, the hydraulic line controlled device having a control line port and one or more fluid leakage paths; and a density barrier having first and second ends, wherein the first end is coupled to the control line port and the second end is configured to couple to a closed loop control line extending from a surface installation, the density barrier having an axial loop relative to the hydraulic line controlled device and positioned below the one or more fluid leakage paths, thereby preventing migration of leakage fluid from the one or more fluid leakage paths to the surface installation.

2. The downhole completion device as recited in claim 1, wherein the density barrier further includes a circumferential loop relative to the hydraulic line controlled device, the axial loop and the circumferential loop preventing migration of leakage fluid from the one or more fluid leakage paths to the surface installation regardless of a directional orientation of the hydraulic line controlled device.

3. The downhole completion device as recited in claim 2, wherein the axial loop and the circumferential loop form an omnidirectional low density fluid trap.

4. The downhole completion device as recited in claim 2, wherein the circumferential loop further comprises a single circumferentially extending tubing section.

5. The downhole completion device as recited in claim 4, wherein the circumferentially extending tubing section extends at least 180 degrees around the hydraulic line controlled device.

6. The downhole completion device as recited in claim 2, wherein the circumferential loop further comprises a pair of circumferentially extending tubing sections.

7. The downhole completion device as recited in claim 6, wherein each of the circumferentially extending tubing sections extends at least 180 degrees around the hydraulic line controlled device.

8. The downhole completion device as recited in claim 2, wherein at least a portion of the circumferential loop further comprises a tubing section that does not extend exclusively in the circumferential direction.

9. The downhole completion device as recited in claim 1, wherein at least a portion of the axial loop further comprises a tubing section that does not extend exclusively in the axial direction.

10. The downhole completion device as recited in claim 1, wherein the axial loop further comprises a pair of axially extending tubing sections.

11. The downhole completion device as recited in claim 1, wherein the leakage fluid is at least one of a liquid and a gas having a density that is lower than the density of a control fluid in the control line.

12. The downhole completion device as recited in claim 1, further including a check valve supported by the hydraulic line controlled device, the check valve oriented such that it is configured to be in downstream fluid communication with the control line extending from the surface installation.

13. A subterranean production well, comprising:

a surface installation;

a wellbore extending into a subterranean formation below the surface installation;

a conduit positioned within the wellbore and extending into the subterranean formation;

a closed loop control line having an uphole end and a downhole end, the control line extending from the surface installation into the subterranean formation substantially along the conduit; and a downhole completion device coupled to the conduit, the downhole completion device including;

a hydraulic line controlled device, the hydraulic line controlled device having a control line port and one or more fluid leakage paths; and a density barrier having first and second ends, wherein the first end is coupled to the control line port and the second end is coupled to the downhole end of the control line, the density barrier having an axial loop relative to the hydraulic line controlled device and positioned below the one or more fluid leakage paths, thereby preventing migration of leakage fluid from the one or more fluid leakage paths up the control line and to the surface installation.

14. The subterranean production well as recited in claim 13, wherein the density barrier further includes a circumferential loop relative to the hydraulic line controlled device, the axial loop and the circumferential loop preventing migration of leakage fluid from the one or more fluid leakage paths to the surface installation regardless of a directional orientation of the hydraulic line controlled device.

15. The subterranean production well as recited in claim 14, wherein the axial loop and the circumferential loop form an omnidirectional low density fluid trap.

16. The subterranean production well as recited in claim 14, wherein the circumferential loop further comprises a single circumferentially extending tubing section.

17. The subterranean production well as recited in claim 16, wherein the circumferentially extending tubing section extends at least 180 degrees around the hydraulic line controlled device.

18. The subterranean production well as recited in claim 14, wherein the circumferential loop further comprises a pair of circumferentially extending tubing sections.

19. The subterranean production well as recited in claim 18, wherein each of the circumferentially extending tubing sections extends at least 180 degrees around the hydraulic line controlled device.

20. The subterranean production well as recited in claim 14, wherein at least a portion of the circumferential loop further comprises a tubing section that does not extend exclusively in the circumferential direction.

21. The subterranean production well as recited in claim 13, wherein at least a portion of the axial loop further comprises a tubing section that does not extend exclusively in the axial direction.

22. The subterranean production well as recited in claim 13, wherein the axial loop further comprises a pair of axially extending tubing sections.

23. The subterranean production well as recited in claim 13, wherein the leakage fluid is at least one of a liquid and a gas having a density that is lower than the density of a control fluid in the control line.

24. The subterranean production well as recited in claim 13, further including a check valve supported by the hydraulic line controlled device, the check valve oriented such that it is configured to be in downstream fluid communication with the control line extending from the surface installation.

* * * * *